US008002317B2

(12) United States Patent
Satram et al.

(10) Patent No.: US 8,002,317 B2
(45) Date of Patent: Aug. 23, 2011

(54) WINDOW LOCK WITH AUTOMATIC LATCH RETENTION MECHANISM AND ASSOCIATED METHOD

(75) Inventors: Ramesh Satram, Charlotte, NC (US); Robert Joseph Kinsella, Alton, IL (US); Camden Bennett White, Wilmington, NC (US)

(73) Assignee: Imperial USA, Ltd., Charlotte, NC (US)

( * ) Notice: Subject to any disclaimer, the term of this patent is extended or adjusted under 35 U.S.C. 154(b) by 1175 days.

(21) Appl. No.: 11/696,448

(22) Filed: Apr. 4, 2007

(65) Prior Publication Data

US 2008/0246287 A1 Oct. 9, 2008

(51) Int. Cl.
*E05B 63/20* (2006.01)

(52) U.S. Cl. ..... 292/336; 292/163

(58) Field of Classification Search ..... 292/165, 292/138, 177, DIG. 31, 32–34, 336, 262, 292/265, 268, 92, 163, 169, 175, DIG. 20; 70/89, 90; 49/449
See application file for complete search history.

(56) References Cited

U.S. PATENT DOCUMENTS

| | | | | |
|---|---|---|---|---|
| 308,055 | A | 11/1884 | Buck | |
| 359,119 | A | 3/1887 | Willcox | |
| 385,935 | A | 7/1888 | Jackson | |
| 557,134 | A | 3/1896 | Lowe | |
| 635,982 | A | 10/1899 | Smith | |
| 739,410 | A | 9/1903 | Goerk | |
| 769,386 | A | 9/1904 | Johnson | |
| 864,571 | A | 7/1908 | Barber et al. | |
| 917,567 | A | 4/1909 | Eddy | |
| 926,899 | A | 7/1909 | Roy | |
| 959,559 | A | 3/1910 | Landis | |
| 999,595 | A | 8/1911 | Roy | |
| 1,012,803 | A | 12/1911 | Brough | |
| 1,076,650 | A | 10/1913 | Eddy | |
| 1,077,312 | A | 11/1913 | Sloan | |
| 1,116,213 | A | 11/1914 | Beardsley | |
| 1,445,429 | A | 2/1923 | Ballard | |
| 1,651,048 | A | 11/1927 | Talbot | |
| 1,891,940 | A | 12/1932 | McAllister | |
| 2,061,493 | A | 11/1936 | Tracy | |
| 2,158,260 | A | 5/1939 | Stillman | |
| 2,421,196 | A | 5/1947 | Granberg | |
| 2,480,016 | A | 8/1949 | Granberg | |
| 2,627,435 | A | 2/1953 | Borrup | |
| 2,846,258 | A | 8/1958 | Granberg | |
| 2,884,276 | A | 4/1959 | Baptist | |
| 4,063,766 | A | 12/1977 | Granberg | |
| 6,764,115 | B1 | 7/2004 | Speed et al. | |
| 6,848,728 | B2 * | 2/2005 | Rotondi et al. | 292/336 |
| 7,097,214 | B2 * | 8/2006 | Tsai | 292/157 |

(Continued)

*Primary Examiner* — Kristina R Fulton
(74) *Attorney, Agent, or Firm* — Alston & Bird LLP

(57) ABSTRACT

A window lock with an automatic latch retention mechanism and an associated method of securing adjustable frame members of a window are provided. The lock generally includes a housing that can be secured to a first window frame member, a latch member slidably mounted in the housing, a rotatably handle configured to actuate the latch member, and a retention mechanism configured to automatically retain the latch member in the retracted position until the first and second window frame members are relatively adjusted to a closed configuration. The lock can automatically adjust to a locked configuration when the window is closed and remain in an unlocked configuration while being adjusted. The rotatable handle, which can be used to retract the latch member, is configured to provide an indication of the configuration of the lock so that a user can easily identify whether the lock is locked or unlocked.

19 Claims, 19 Drawing Sheets

U.S. PATENT DOCUMENTS 7,118,142 B2 10/2006 Xu
7,591,494 B2 * 9/2009 Mitchell ..... 292/336
7,676,990 B2 * 3/2010 Bestler et al. ..... 49/449
7,874,598 B2 * 1/2011 Chung ..... 292/163
2004/0207212 A1 * 10/2004 Wallis ..... 292/241
2006/0244269 A1 * 11/2006 Rotondi ..... 292/213
2008/0012357 A1 * 1/2008 Liang et al. ..... 292/240

* cited by examiner

WINDOW LOCK WITH AUTOMATIC LATCH RETENTION MECHANISM AND ASSOCIATED METHOD

BACKGROUND OF THE INVENTION

1) Field of the Invention

Embodiments of this invention relate to a window lock for securing frame members of a window to prevent relative adjustment of the frame members and, more particularly, to a window lock having a retention mechanism that automatically retains the lock in an unlocked configuration.

2) Description of Related Art

A typical sliding window includes two vertically adjustable frame members. When the window is closed and locked, the two frames are oriented vertically and a lock affixed to the top of the bottom frame member is engaged to a keeper affixed to the bottom of the top frame member. One conventional lock for such a sliding window includes a handle that is rotatable about a vertical axis. When the handle is rotated to its locked position, a hook-like arm rotates toward the top frame member and engages a corresponding hook-like arm defined by the keeper. The engagement of these two hook-like arms prevents the bottom frame from being raised or the top frame member from being lowered, thereby locking the window. In order to open the window, a person first rotates the handle of the lock to rotate the hook-like arm of the lock from the keeper. The lock then stays in the unlocked configuration until manually locked again.

A variety of automatic window locks have been proposed to automatically lock upon closing of the window and thereby eliminate the necessity for manually locking the window. One such conventional automatic window lock includes a retractable latch that can slide toward or away from the keeper. The latch is biased by a spring to its extended position so that, when the window is closed, the latch slides toward the keeper, and the keeper receives the latch to secure the window. A person can unlock the window by using a handle to retract the latch, overcoming the bias of the spring. Some automatic window locks require the user to manually hold the handle to keep the latch in the retracted position. Thus, in order to open the window, the person must manually hold the handle to overcome the force of the spring while also adjusting the position of one of the window frame members.

Alternatively, some automatically locking window locks are configured to remain unlocked until closed. For example, the lock can include a pivotably adjustable latch member that is configured to be biased toward the keeper until a button-like handle is actuated to rotate the latch member from the keeper. The handle stays in position once unlocked until the window is closed. Thus, the window can be opened without holding the handle in the unlocked position. Although the handle of such a lock can indicate whether the lock is locked or unlocked, a person unfamiliar with the particular lock must typically inspect the lock closely to determine the status of the lock, thereby increasing the difficulty of operating the lock.

Thus, there exists a need for an improved lock that can automatically lock upon closing of a window and that also can be automatically retained in an unlocked configuration, e.g., so that the window can be adjusted from a closed position to an open position without requiring the lock to be manually retained in the unlocked configuration. Further, the lock should facilitate easy operation, preferably even by a person that is unfamiliar with the particular operation of the lock.

SUMMARY OF THE INVENTION

Embodiments of the present invention provide a window lock with an automatic latch retention mechanism and an associated method of securing adjustable frame members of a window. The lock can automatically adjust to a locked configuration when the window is closed. Once adjusted to an unlocked configuration, the lock can be automatically retained in the unlocked configuration, even while the window is adjusted, so that manual retention of the lock in the unlocked configuration is not required. A rotatable handle, which can be used to unlock the lock, is configured to adjust between locked and unlocked positions and thereby provides a visual indication of the configuration of the lock. In some cases, the locked and unlocked positions of the handle can be easily viewed and recognized by a user, e.g., a user that is familiar with conventional manual locks but unfamiliar with the operation of automatic locks.

According to one embodiment, the window lock is provided for securing a first frame member of a window to a keeper structure that is attached to a second frame member of the window, to thereby prevent a relative adjustment of the window frame members in a first direction of motion, such as a sliding adjustment of either window frame member relative to the other frame member. The lock includes a housing that is configured to be secured to the first window frame member. The housing defines an internal space, and a latch member is slidably mounted in the internal space.

The latch member is configured to be slidably adjusted in alternate rearward and forward directions between a retracted position and an extended position. In the extended position, the latch member is configured to extend in the forward direction from the housing to engage the keeper structure. In the retracted position, the latch member is configured to retract in the rearward direction at least partially into the housing to disengage the keeper structure. When adjusted to the unlocked position, the handle can extend in a direction that is generally normal to a plane defined by each of the window frame members, and/or the handle can extend in a direction generally parallel to the sliding direction of motion of the latch member between the extended and retracted positions. The axis about which the handle is configured to rotate can be substantially parallel to the first direction of motion of the relative adjustment of the window frame members. According to one aspect of the invention, the housing can define opposite front and rear ends, with the latch member being configured to extend through the front end, and the handle in the unlocked position extending rearwardly from the rear end of the housing so that the handle provides a visual indicator that the latch member is retracted.

The lock can be adjusted by a rotatable handle that defines a shaft and a grip portion. The shaft extends through the housing, e.g., into the internal space of the housing, and is configured to actuate the latch member. The grip portion, which can be disposed outside the internal space of the housing, defines an end that is distal to the shaft, e.g., at the opposite end of the handle from the shaft. The handle is rotatably adjustable about an axis generally defined by the shaft between a locked position and an unlocked position such that, when the end of the grip portion is rotated in the rearward direction, the latch member is adjusted from the extended position to the retracted position and the handle extends in the rearward direction to indicate that the latch member is retracted.

A retention mechanism is configured to automatically retain the latch member in the retracted position such that the first and second window frame members can be relatively adjusted until the frame members are relatively adjusted to a closed configuration. The retention mechanism can be configured to automatically release the latch member to an extended position when the window frame members are relatively adjusted to a closed configuration and the lock is adjusted to a position proximate the keeper structure, e.g., so that the lock can automatically lock when the window is closed. In one embodiment, the retention mechanism includes a rotatable disk, a rocker arm, a trigger, and one or more biasing members. The rotatable disk is mounted in the internal space of the housing and connected to the shaft of the handle so that the disk is configured to rotate with the shaft and the handle about an axis, e.g., an axis defined by the shaft. The rocker arm defines a shaft portion and a hook portion, and the rocker arm is configured to rotate about the shaft portion so that the rocker arm can be adjusted between an engaged position and a disengaged position. In the engaged position, the hook portion is engaged with the disk to prevent the disk from rotating and thereby hold the latch member in the retracted position. In the disengaged position, the hook portion is disengaged from the disk so that the disk is configured to rotate free or retention by the rocker arm and the latch member is configured to be adjusted to the extended position. The trigger member is configured to rotate between an extended position and a retracted position. In the extended position, the trigger member extends from the housing. In the retracted position, the trigger member is retracted at least partially into the housing so that the trigger member is configured to contact the keeper structure and be adjusted to the retracted position by the keeper structure when the window frame members are relatively adjusted to a closed configuration and the lock is thereby adjusted to a position proximate the keeper structure. The trigger member is also configured to engage the rocker arm to adjust the rocker arm to the disengaged position of the rocker arm when the trigger member is adjusted to the retracted position. The one or more biasing member, such as a spring, is configured to bias the latch member to the extended position and the rocker arm to the engaged position.

The keeper structure can be configured to be attached to the second window frame member so that the latch member is configured to be advanced into the keeper structure when the window frame members are adjusted to the closed configuration, and the keeper structure engages the latch member when the latch member is in the extended position to prevent relative adjustment of the window frame members. In some cases, the housing of the lock can define first and second portions that define a slot therebetween for receiving the keeper structure. The first portion of the housing can define the internal space, and the second portion can define an angled surface so that the slot is tapered, with the angled surface being configured to adjust the keeper structure toward the first portion of the housing as the window is closed and the keeper structure is received in the slot, e.g., to adjust the two window frame members together and effect a seal therebetween.

According to one embodiment of the present invention, a method is provided for securing a lock attached to a first frame member of a window to a keeper structure attached to a second frame member of the window and thereby preventing a relative adjustment of the first and second window frame members in a first direction of motion, e.g., a relative sliding adjustment of the frames for opening and closing the window. The method includes providing a housing secured to the first window frame member. A handle that extends from the housing is rotated from a locked position to an unlocked position to thereby slidingly retract a latch member from the keeper structure and at least partially into the housing. In the unlocked position, the handle extends generally rearwardly to indicate that the lock is unlocked. The handle can be manually rotated to the unlocked position and, in the unlocked position, the handle can be configured to extend in a direction generally parallel to a sliding direction of motion of the latch member. In some cases, a manual rotation of the handle to the unlocked position can retract the latch member in a rearward direction through a front end of the housing and also result in an adjustment of the handle to extend in the rearward direction from a rear end of the housing opposite the front end so that the handle provides a visual indicator that the latch member is retracted. In some cases, the handle can be rotated about an axis that is substantially parallel to a direction of motion of the relative adjustment of the window frame members.

According to one aspect of the invention, the rotation of the handle can include rotating a disk that is connected to the handle and mounted in the housing so that a rocker arm is adjusted to engage the disk to prevent the disk from rotating and thereby hold the latch member in the retracted position. Further, the adjustment of the window frame members to the closed configuration can include contacting a trigger member with the keeper structure so that the trigger member rotates at least partially into the housing to engage the rocker arm and adjust the rocker arm to disengage the rocker arm from the disk so that the disk and the handle rotate to an unlocked configuration as the latch member is adjusted to the extended position by a biasing member.

The method further includes relatively adjusting the window frame members from a closed configuration to an open configuration so that the lock is moved from the proximity of the keeper structure, while the latch member is automatically retained in the retracted position by a retention mechanism. Thereafter, the window frame members are relatively adjusted from the open configuration to the closed configuration such that the lock is moved proximate the keeper structure, the retention mechanism releases the latch member, and the latch member is automatically adjusted to the extended position to lock the window. In some cases, when the window frame members are relatively adjusted to the closed configuration, the handle is automatically adjusted to the locked position by a bias member, and the handle in the locked position extends generally parallel to the window frame members. Closing the window frame members can include receiving the keeper structure at least partially into a slot that is defined between first and second portions of the housing and extending the latch member through the keeper structure and at least partially into the second portion of the housing to prevent relative adjustment of the window frame members. Further, the housing and the keeper structure can be relatively adjusted so that the keeper structure contacts an angled surface defined by the second portion of the housing and is thereby adjusted toward the first portion of the housing as the window is closed.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, but which are not necessarily drawn to scale, wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
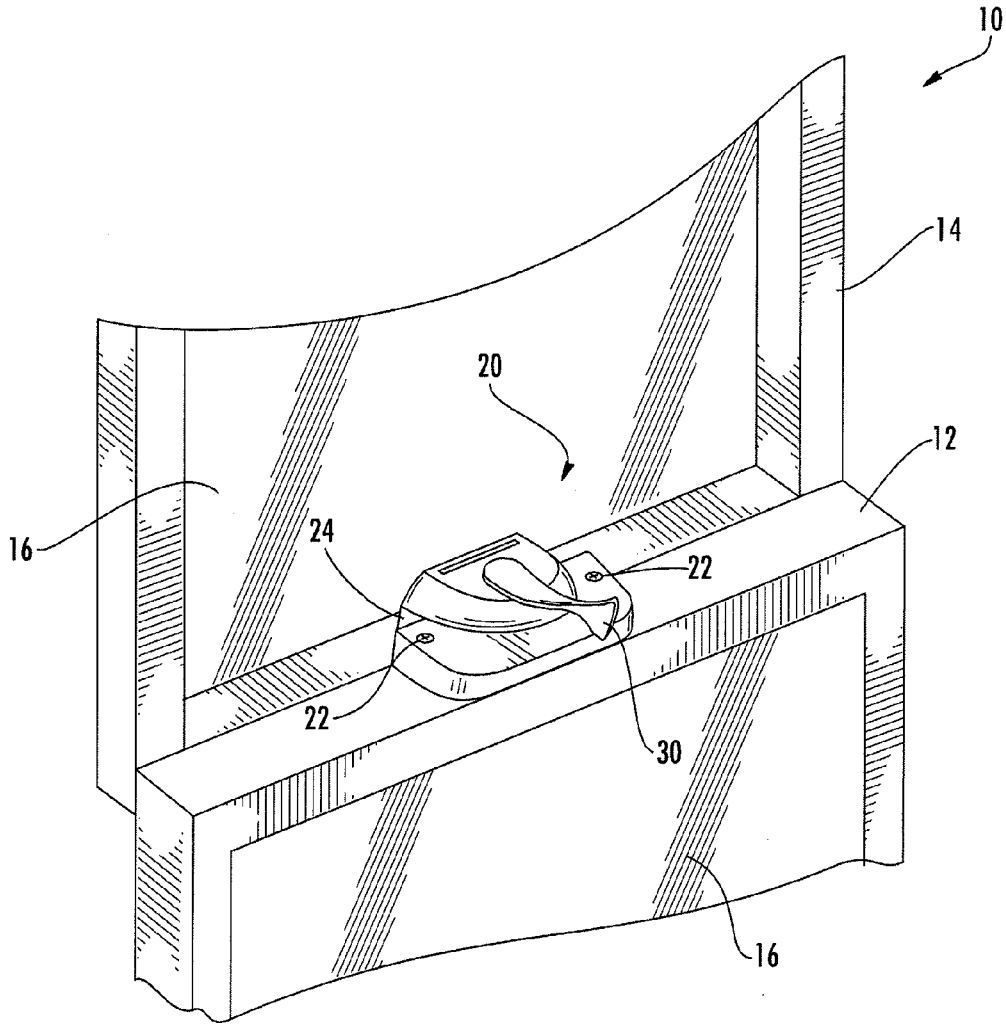
FIG. 1 is a perspective view illustrating an adjustable window with a window lock according to one embodiment of the present invention.

Referring now to the drawings and, in particular, to FIG. 1, there is shown a window 10 with a lock 20 according to one embodiment of the present invention. The window 10 includes first and second window frame members 12, 14 that are mounted to adjust vertically in an outer frame (not shown). When the window 10 is unlocked, each frame member 12, 14, which includes one or more glass panes 16, can be slidably raised or lowered in the outer frame. With the first frame member 12 in its lowered position and the second frame member 14 in its raised position, as shown in FIG. 1, the window 10 can be locked. In particular, the window lock 20 secures the first frame member 12 to the second frame member 14 to prevent adjustment of either frame member 12, 14 relative to the other frame member 12, 14. In this regard, the window lock 20 is fixedly attached to the top of the first frame member 12 by screws 22, and a keeper structure 24 is similarly fixedly attached to the bottom of the second frame member 14 so that, when the window frame members 12, 14 are moved to their closed position as shown in FIG. 1, the lock 20 is positioned proximate the keeper structure 24 such that the lock 20 can engage the keeper structure 24. The window 10 shown in FIG. 1 is exemplary of one type of sliding window, and it is appreciated that the locks 20 of the present invention can be used with windows of various other types and configurations.

Figure 2:
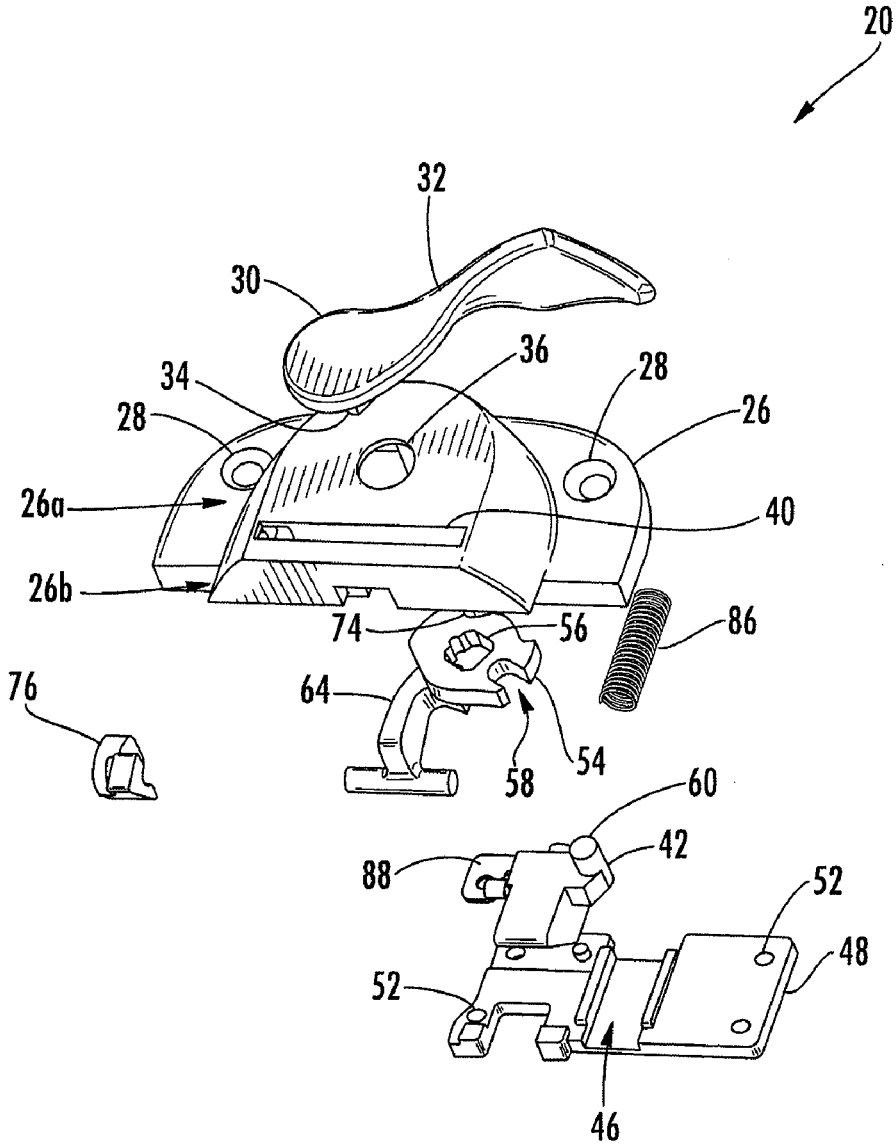
FIGS. 2 and 3 are perspective views illustrating the window lock of FIG. 1 in an unassembled configuration.
Figure 3:
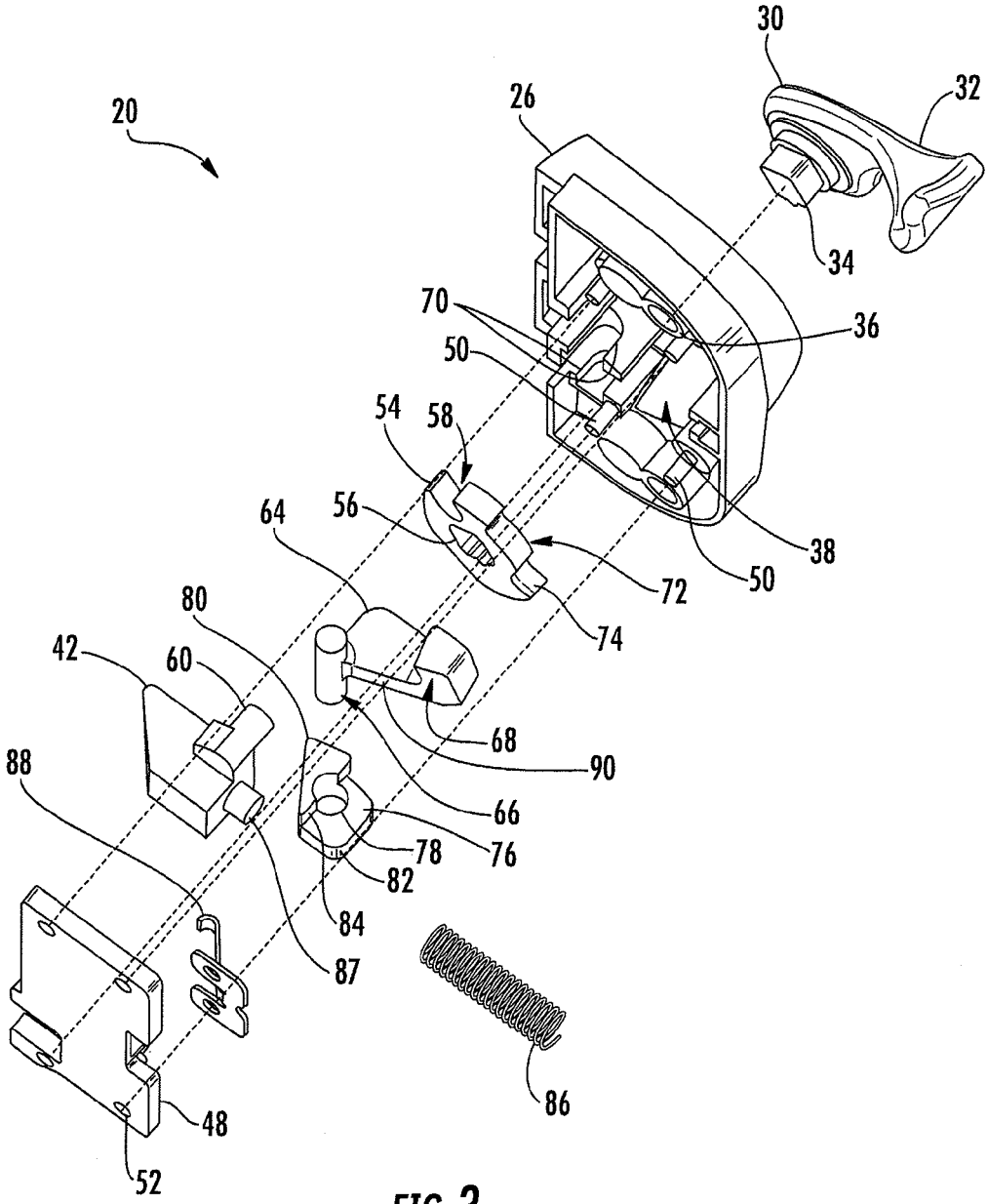

As shown in FIGS. 2 and 3, the window lock 20 includes a housing 26 that can be secured to the frame member 12 of the window 10, e.g., by the screws 22 that are inserted through holes 28 of the housing 26. A rotatable handle 30 is mounted on the housing 26. The handle 30 defines a grip portion 32, one end of which can be gripped and rotatably adjusted by a user. At the opposite end of the grip portion 32, the handle 30 defines a shaft 34 that extends through an aperture 36 of the housing 26 and into an internal space 38 defined by the housing 26.

In the illustrated embodiment, the housing 26 includes first and second portions 26*a*, 26*b* that define a slot 40 (FIG. 10) therebetween for at least partially receiving the keeper structure 24. The first portion 26*a* defines the internal space 38 of the housing 26 in which the various members of the lock mechanism can be disposed, as discussed below. The second portion 26*b* of the housing 26 can be configured to be disposed opposite the keeper structure 24 from the first portion 26*a* when the window 10 is closed. That is, with the first portion 26*b* of the housing 26 secured to the first frame member 12 and the keeper structure 24 secured to the second frame member 14, the second portion 26*b* of the housing 26 is configured to be disposed opposite the keeper structure 24 from the first portion 26*a* so that the keeper structure 24 is disposed in the slot 40 of the housing 26. In this way, the keeper structure 24 can be at least partially enclosed by the housing 26 of the lock 20, e.g., to more securely engage the keeper structure 24 by preventing the keeper structure 24 from moving laterally away from the first portion 26*a* of the housing 26 of the lock 20. The second portion 26*b* of the housing 26 can also prevent access to the keeper structure 24 when the window 10 is closed. As described further below, the shape of the second portion 26*b* of the housing 26 can facilitate the alignment of the keeper structure 24 with the lock 20.

A latch member 42 is provided in the internal space 38 of the housing 26. The latch member 42 is slidably adjustable in forwardly and rearwardly directions 44*a*, 44*b* (FIG. 6) generally toward and away from the keeper structure 24, i.e., in a direction perpendicular to the direction of adjustment of the frame member(s) 12, 14 of the window 10. In the illustrated embodiment, the latch member 42 is configured to slide in a slot 46 defined by a bottom plate 48. The bottom plate 48 can be secured to the housing 26 by the engagement of posts 50 that extend from the housing 26 and through apertures 52 defined by the plate 48. As described below, the latch member 42 can be slidably adjusted in the slot 46 to selectively engage or disengage the keeper structure 24 and thereby selectively lock or unlock the window 10. That is, the latch member 42 can be selectively adjusted in a linear motion in forward and rearward directions, i.e., toward or away from the keeper structure, respectively.

The rotatable handle 30 is configured to adjust the position of the latch member 42. In the illustrated embodiment, the handle 30 and latch member 42 are connected by a rotatable disk 54. The disk 54 defines an aperture 56 that receives the shaft 34 of the handle 30, and the aperture 56 corresponds to the configuration of the shaft 34 so that the disk 54 and handle 30 rotate together. In particular, as shown in FIG. 3, the cross-sectional shape of the shaft 34 can define a polygon (such as a square with rounded corners and a rib on one side), and the aperture 56 can define the same shape so that the aperture 56 is configured to receive the shaft 34 in a particular orientation.

An outer periphery of the disk 54 defines a slot 58 that receives a post 60 extending from the latch member 42. As the disk 54 rotates about an axis defined by the shaft 34 of the handle 30, the slot 58 is adjusted toward or away from the keeper structure 24. Thus, the post 60 is also adjusted toward or away from the keeper structure 24, i.e., in the forward or rearward directions. In particular, as evident from FIG. 2, when the handle 30 is rotated in a counterclockwise direction (as seen from above), the disk 54 also rotates counterclockwise, and the latch member 42 is adjusted rearwardly to retract the latch member 42 into the housing 26 to disengage the keeper structure 24. When the latch member 42 is adjusted forwardly to extend the latch member 42 at least partially out of the housing 26 to engage the keeper structure 24, the handle 30 and disk 54 rotate in a clockwise direction. In this way, the disk 54 linearly retracts the latch member 42 when the handle 30 is rotationally adjusted to its unlocked position. Similarly, when the latch member 42 is linearly extended, the disk 54 rotationally adjusts the handle 30 to its unlocked configuration, thereby providing a link between the rotational motion of the handle 30 and the linear motion of the latch member 42.

Figure 4:
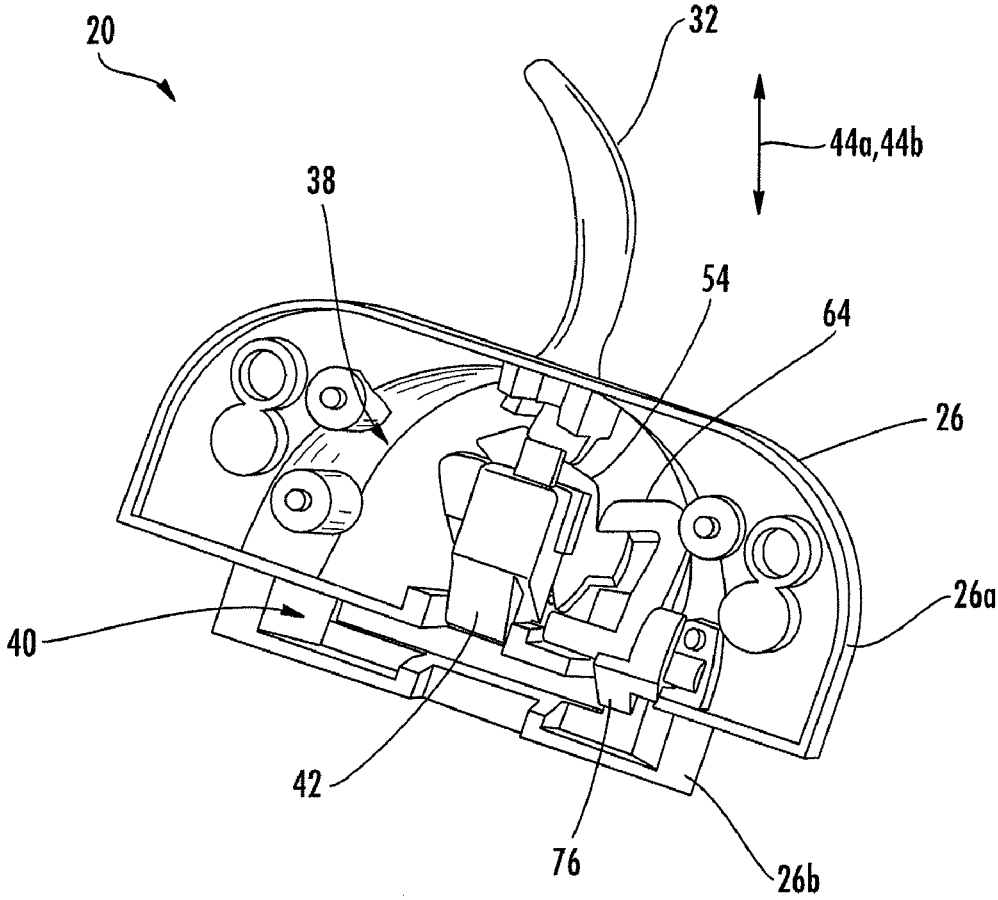
FIGS. 4, 4A, and 5 are perspective views illustrating the window lock of FIG. 1, shown in an unlocked configuration.
Figure 5:
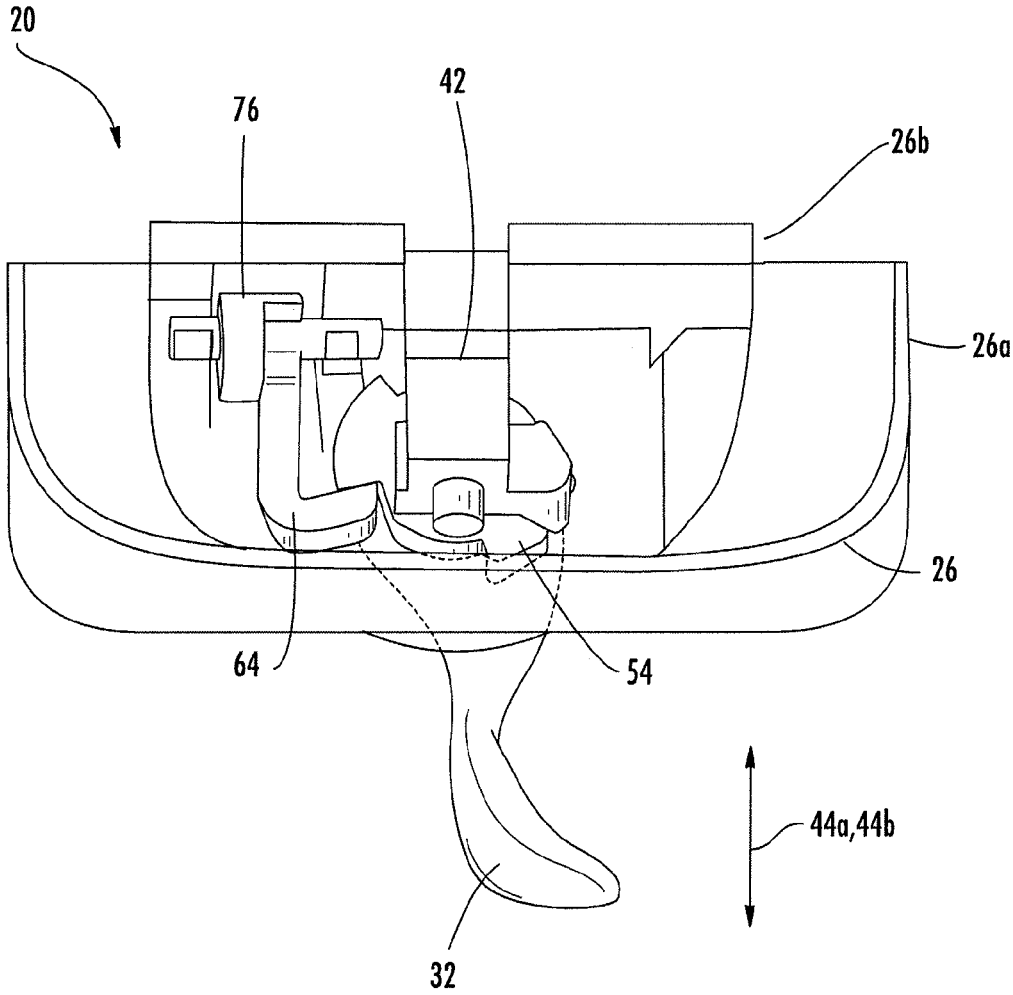
Figure 6:
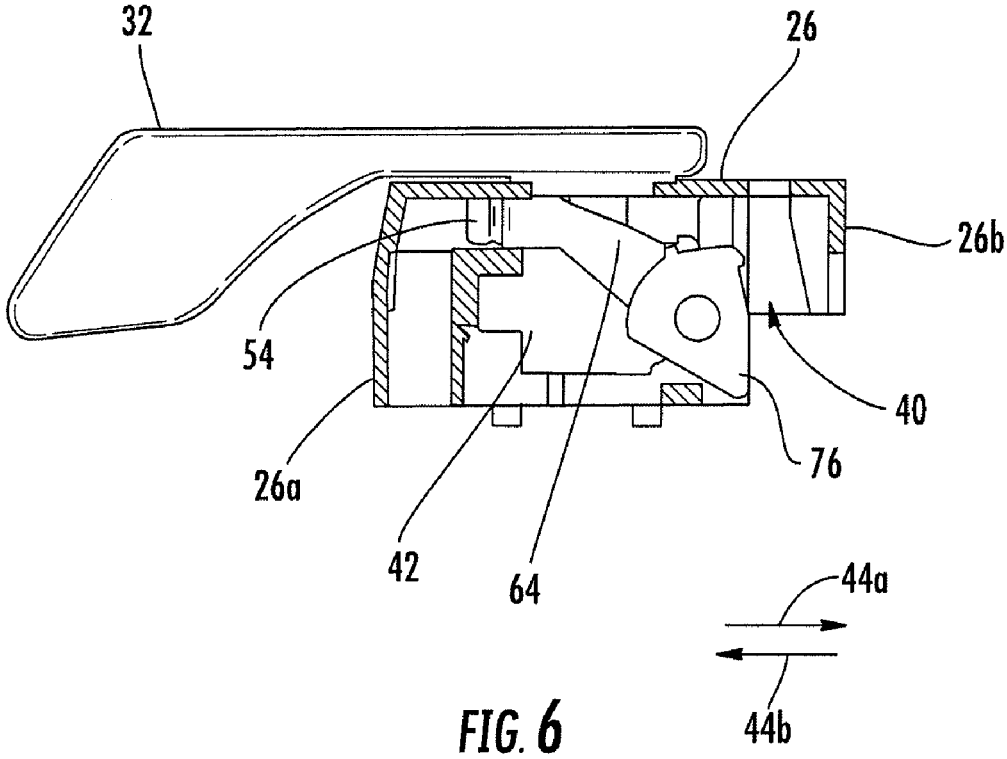
FIG. 6 is a partial cut-away view in elevation illustrating the window lock of FIG. 1 in the unlocked configuration.

FIGS. 4-6 illustrate the lock 20 in the unlocked configuration, such that the latch member 42 is retracted (i.e., adjusted rearwardly in the housing 26, generally away from the keeper structure 24) and the handle 30 is rotatably adjusted to an unlocked position in which the grip portion 32 extends rearwardly from the housing 26, i.e., in a direction that extends generally away from the keeper structure 24 and a plane defined by the window frame members 12, 14, e.g., so that the handle 30 extends along directions 44*a*, 44*b* that is generally perpendicular to the plane of the frame members 12, 14 and generally parallel to the direction of motion of the latch member 42.

Figure 7:
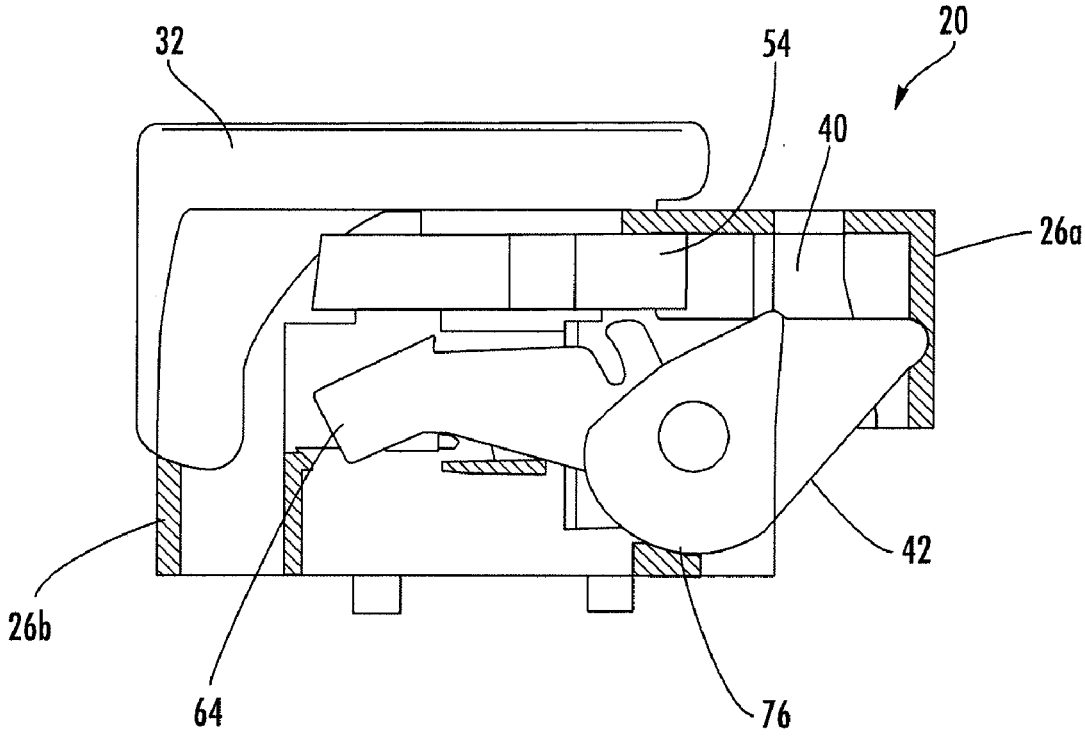
FIG. 7 is a partial cut-away view in elevation illustrating the window lock of FIG. 1 in an locked configuration.
Figure 8:
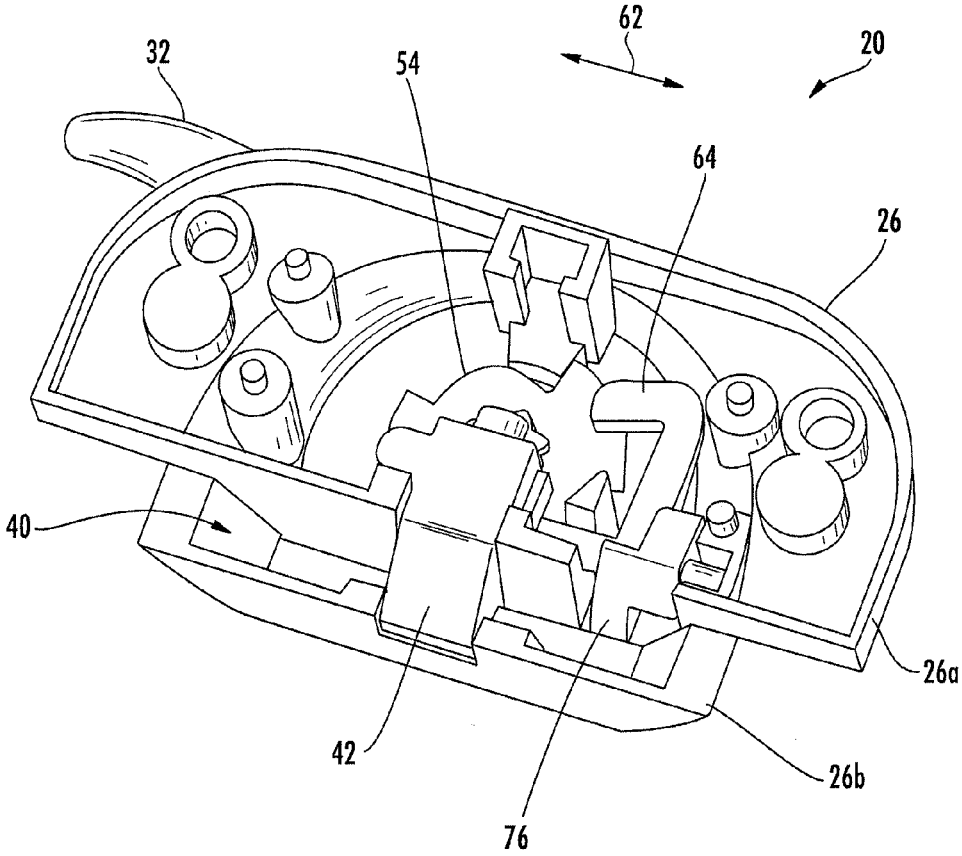
FIGS. 8 and 9 are perspective views illustrating the window lock of FIG. 1, shown in the locked configuration.
Figure 9:
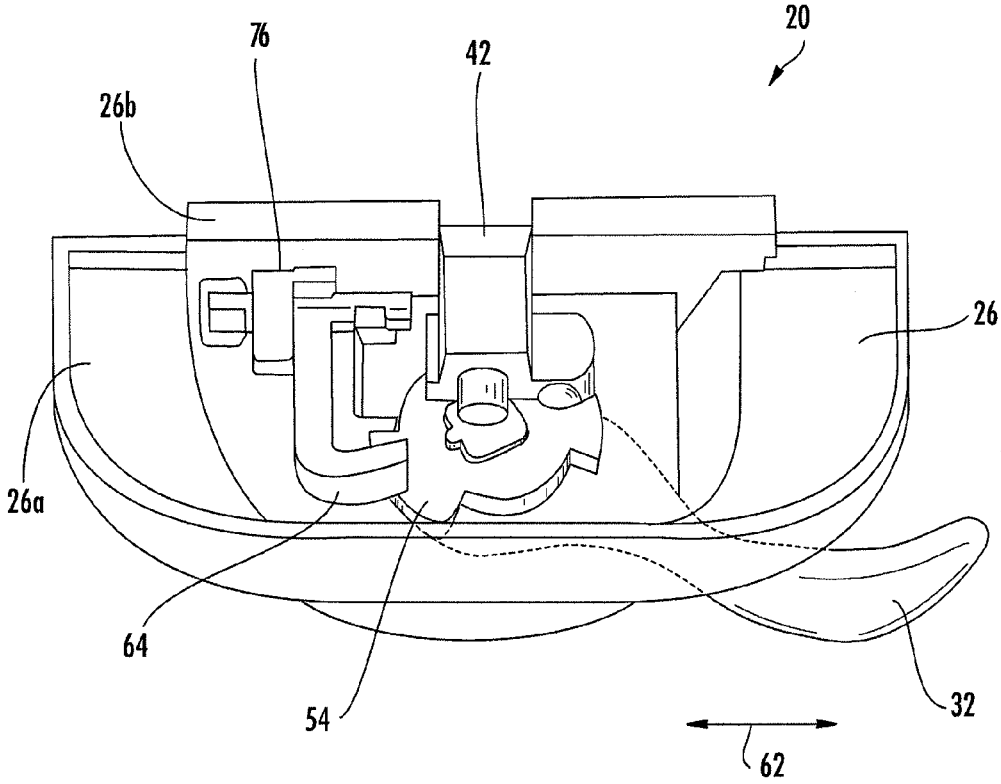

FIGS. 7-9 illustrate the lock 20 in the locked configuration, such that the latch member 42 is extended (i.e., adjusted forwardly in the housing 26, generally toward the keeper structure 24) and the handle 30 is rotatably adjusted to a locked position in which the grip portion 32 is relatively closer to the keeper structure 24 and the plane defined by the window frame members 12, 14, e.g., so that the handle 30 extends along a direction 62 that is generally parallel to the plane of the frame members 12, 14 and generally perpendicular to the direction of motion of the latch member 42.

Figure 10:
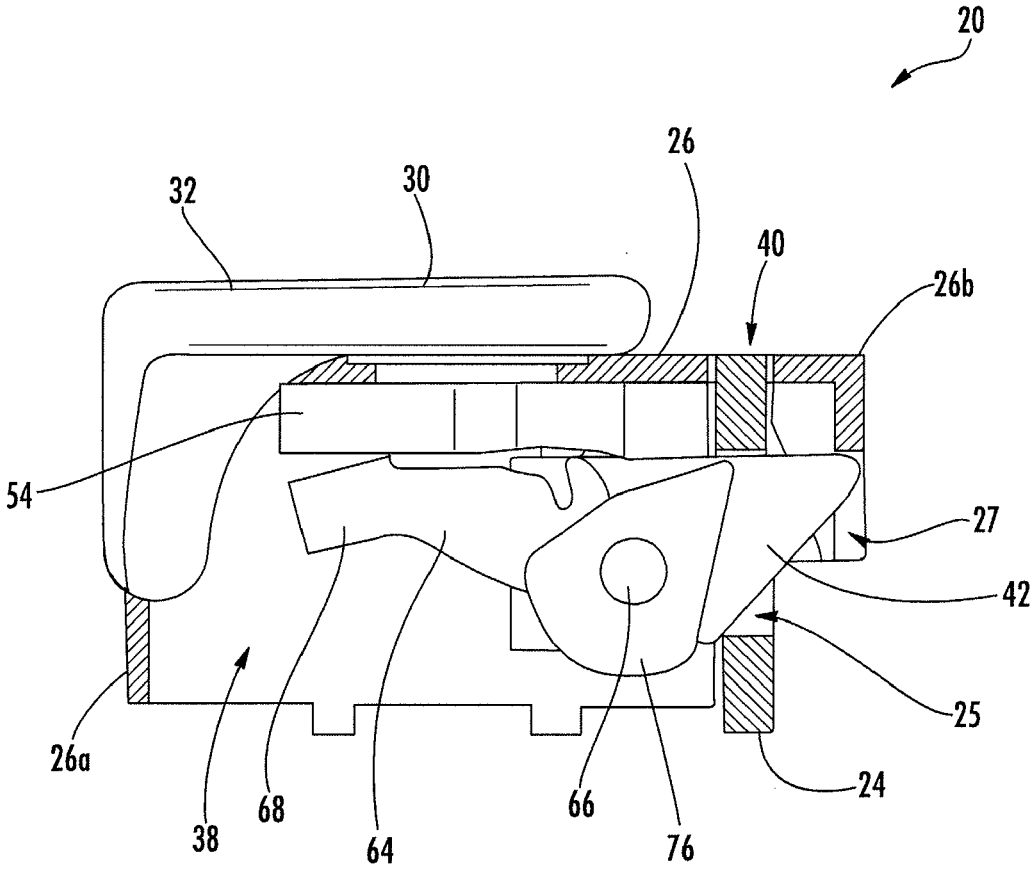
FIG. 10 is a partial cut away view in elevation schematically illustrating the window lock of FIG. 1 in a locked configuration, with the window closed.

In the illustrated embodiment, the latch member 42 is configured to extend through an aperture 25 defined by the keeper structure 24 (FIG. 10). Further, the latch member 42 extends into the second portion 26*b* of the housing 26 and into an aperture 27 defined by the second portion 26*b* to thereby engage the latch member 42 with the second portion 26*b* of the housing 26. In this way, the latch member 42 can be supported on both sides of the keeper structure 24 when locked.

The latch member 42 can be automatically retained in the retracted position by a retention mechanism. In the illustrated embodiment, the retention mechanism includes a rocker arm 64 that selectively engages the disk 54 to prevent the disk 54 from rotating and, hence, prevent the latch member 42 from adjusting to the extended position. The rocker arm 64 includes a shaft portion 66 and a hook portion 68. The shaft portion 66, which is generally cylindrical in FIG. 3, is rotatably mounted in the housing 26. In particular, each end of the shaft portion 66 is received by a respective slot 70 defined by the housing 26, so that the rocker arm 64 is configured to rotate about an axis defined by the shaft portion 66. The hook portion 68 of the rocker arm 64 extends from the shaft portion 66 and, as the rocker arm 64 rotates in opposite directions, the hook portion 68 is adjusted into or out of a plane defined by the disk 54. The disk 54 defines a notch 72 having a shoulder 74 extending radially inward from the periphery of the disk 54. The shoulder 74 is directed generally in the circumferential direction of rotation of the disk 54 that results in extension of the latch member 42. When the hook portion 68 of the rocker arm 64 is adjusted into the plane of the disk 54 and the hook portion 68 engages the shoulder 74 of the disk 54, the hook portion 68 prevents the disk 54 from rotating further in a direction that would result in extension of the latch member 42. Alternatively, when the hook portion 68 is adjusted out of the disk 54 and, thus, disengaged from the disk 54, the disk 54 and latch member 42 are able to rotate without retention by the rocker arm 64. Thus, by selectively engaging the rocker arm 64 with the disk 54 or disengaging the rocker arm 64 from the disk 54, the retention mechanism can be used to selectively retain the latch member 42 in the retracted position and thereby retain the lock 20 in an unlocked configuration.

The rocker arm 64 can be actuated by a trigger member 76, which is rotatably mounted in the housing 26. The trigger member 76 defines a bore 78 through which the shaft portion 66 of the rocker arm 64 extends. A first portion 80 of the trigger member 76 is thicker than a second portion 82 of the trigger member 76 so that the first portion 80 defines a shoulder 84 directed toward the rocker arm 64 and configured to contact the rocker arm 64. When the hook portion 68 of the rocker arm 64 is positioned in the plane of the disk 54 and engaged thereto, and the shoulder 84 of the trigger member 76 is disposed against the rocker arm 64, the first portion 80 of the trigger member 76 extends outward from the housing 26 of the lock 20. Thus, when the trigger member 76 is adjusted into the housing 26, e.g., when the window 10 is closed and the trigger member 76 contacts the keeper structure 24, the first portion 80 of the trigger member 76 is adjusted into the housing 26, so that the trigger member 76 rotates and the shoulder 84 of the trigger member 76 contacts the rocker arm 64 and rotates the rocker arm 64 to disengage the hook portion 68 of the rocker arm 64 from the disk 54.

Figure 4A:
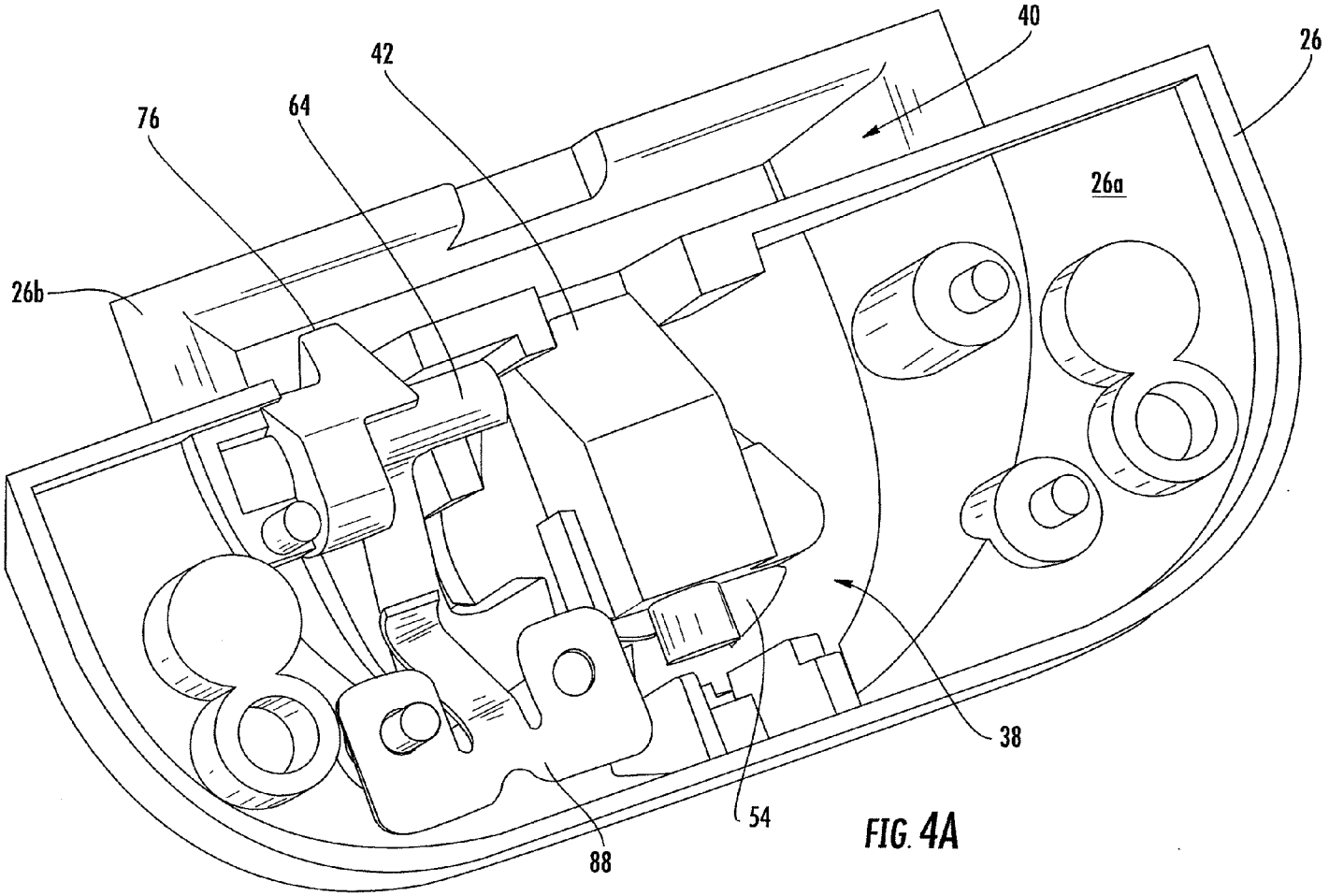

Bias members can be provided to bias the various members to particular positions. In particular, a first spring 86 is disposed in the housing 26 and positioned between the latch member 42 and an interior wall of the housing 26. The first spring 86, which can be a compression spring, biases the latch member 42 to an extended position. A post 87 can extend from the latch member 42 for connecting the latch member 42 to the first spring 86. A second spring 88 is provided between the bottom plate 48 and the rocker arm 64, and the second spring 88 can be secured in place relative to the bottom plate 48 by one or more corresponding posts and holes, such as a hole that receives one of the posts 50 defined by the housing 26 or otherwise. The second spring 88, which can be a cantilever spring is biased against the rocker arm 64 and, due to the tapered or angled surface 90 of the rocker arm 64 directed toward the second spring 88, biases the rocker to a position in which the hook portion 68 is rotated into the plane of the disk 54 so that the rocker arm 64 engages the notch 72 on the disk 54 to prevent rotation of the disk 54. It is appreciated that other types and configurations of bias members can be used. For purposes of illustrative clarity, some of the members of the lock 10 are omitted in the various figures. For example, the second spring 88 is not shown in FIG. 4. The configuration of the second spring 88 relative to the rocker arm 64 is shown in FIG. 4A.

A typical operation of the lock 20 will now be described in connection with FIGS. 10-15. For purposes of illustrative clarity, the lock is only partially and schematically illustrated in FIGS. 10-15 with some components of the lock being omitted. As shown in FIG. 10, the lock 20 is in a locked configuration. That is, the latch member 42 is in the extended position and extends through the aperture 25 of the keeper structure 24. Although the second spring 88 provides a force against the rocker arm 64 to urge the rocker arm 64 toward the disk 54 (i.e., toward the top of the page as shown in FIG. 10), the rocker arm 64 is held in the illustrated configuration (i.e., with the hook portion 68 outside the plane of the disk 54) by the trigger member 76. In particular, the trigger member 76 is in contact with the keeper structure 24 and thereby prevented from extending from the housing 26 from the internal space 38 of the first portion 26*a*, i.e., into the slot 40. The shoulder 84 of the trigger member 76 contacts the corresponding surface of the rocker arm 64 and, thus, prevents the rocker arm 64 from rotating in the clockwise direction as shown in FIG. 10, so that the hook portion 68 of the rocker arm 64 is prevented from contacting and engaging the disk 54. In this configuration, the disk 54, latch member 42, and handle 30 can move without interference from the rocker arm 64. Due to the bias force provided on the latch member 42 by the first spring 86, the latch member 42 is adjusted to and held in the extended position, the disk 54 is rotated to a corresponding position, and the handle 30 is rotated to its corresponding locked configuration. The latch member 42 extends through the keeper structure 24 and prevents the lock 20 from moving relative to the keeper structure 24 and, hence, the window frame members 12, 14 from being adjusted relative to one another. The rocker arm 64 is urged toward the disk 54 by the bias force provided on the rocker arm 64 by the second spring 88; however, due to the orientation of the disk 54, the hook portion 68 of the rocker arm 64 is not aligned with the notch 72 of the disk 54 and does not engage the shoulder 74 in this configuration.

Figure 11:
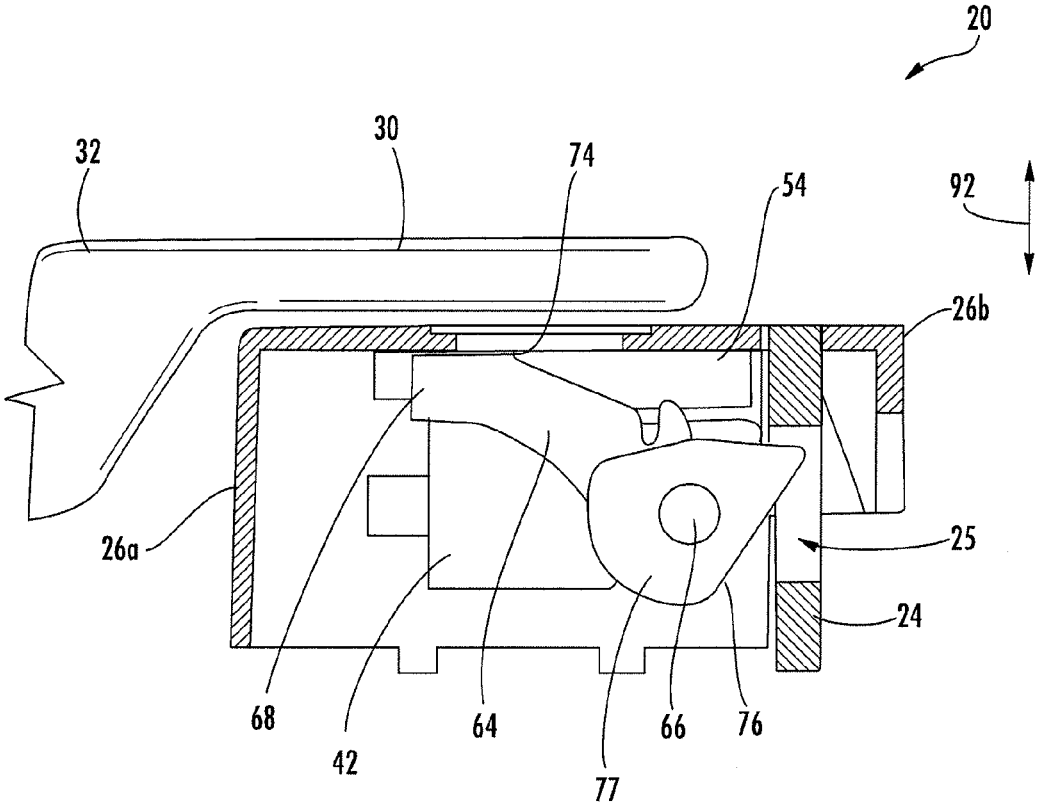
FIG. 11 is a partial cut away view in elevation schematically illustrating the window lock of FIG. 1 in an unlocked configuration, with the window closed.

FIG. 11 illustrates the lock 20 in its unlocked configuration. This configuration can be achieved by a user who grasps the grip portion 32 of the handle 30 and rotates the handle 30 to its unlocked position. That is, the user rotates the handle 30 in a direction that is counterclockwise when viewed from above (as shown in FIGS. 1-2) such that the end of the handle 30 that is distal to the shaft 34 is moved rearwardly and generally away from the plane of the frame members 12, 14. As the handle 30 rotates, the disk 54 also rotates in the same direction, thereby moving the slot 58 of the disk 54 in a rearward direction and adjusting the latch member 42 rearwardly to its retracted position. When the disk 54 is rotated to this position, the notch 72 of the disk 54 is aligned with the hook portion 68 of the rocker arm 64. The rocker arm 64 is adjusted by the bias force of the second spring 88 so that the hook portion 68 is adjusted into the notch 72 and engages the shoulder 74 of the disk 54. With the rocker arm 64 and disk 54 engaged, the rocker arm 64 prevents the disk 54 from rotating, thereby also preventing the handle 30 from moving from its unlocked position and preventing the latch member 42 from moving from its retracted (unlocked) position. In this way, the retention mechanism retains the lock 20 in its unlocked configuration, a user can adjust the window frame members 12, 14, and the user does not need to manually hold the handle in the unlocked position or otherwise maintain the lock 20 in the unlocked configuration while adjusting the window 10.

Figure 12:
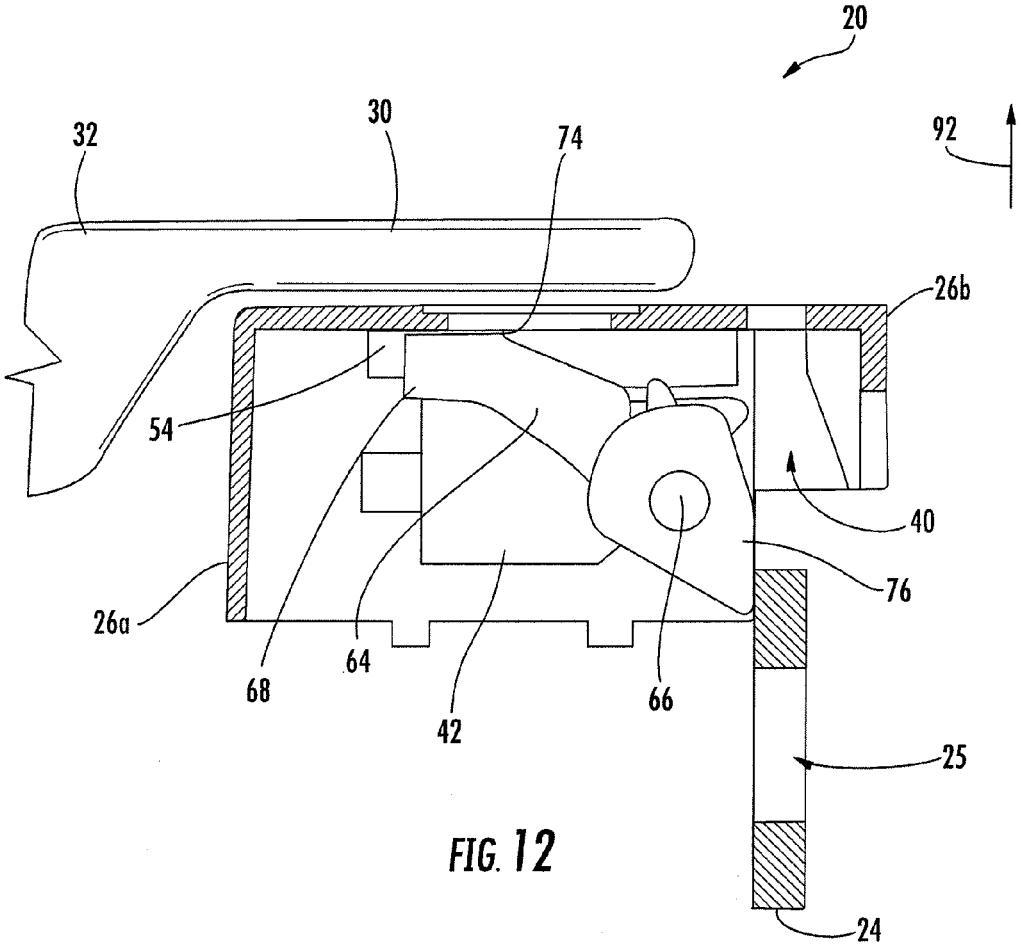
FIG. 12 is a partial cut away view in elevation schematically illustrating the window lock of FIG. 1 in an unlocked configuration, with the window partially opened.

FIG. 12 illustrates the lock 20 as the window frame members 12, 14 are relatively adjusted. That is, in this case, the first frame member, to which the lock 20 is attached, is moved upward and/or the second frame member, to which the keeper structure 24 is attached, is moved downward to adjust the window 10 to an open configuration. As shown in FIGS. 11 and 12, the relative movement of the frame members 12, 14 results in a corresponding relative movement between the lock 20 and the keeper structure 24, i.e., such that the lock 20 moves in direction 92*a* relative to the keeper structure 24. The trigger member 76, which extends at least partially into the keeper structure 24 in FIG. 11, is rotated by the keeper structure 24 as the lock 20 and keeper structure 24 move relative to one another. In particular, as illustrated in FIGS. 11 and 12, the relative movement of the lock 20 and keeper structure 24 results in a rotation of the trigger member 76 that is clockwise as shown in these two figures. Thereafter, with further movement of the lock in direction 92*a*, the lock 20 moves away from the keeper structure 24 and the trigger member 76 no longer contacts the keeper structure 24, and the trigger returns to a rotation position similar to that shown in FIG. 11. In the illustrated embodiment, the trigger member 76 is configured to return to the rotational position of FIG. 11 due to the force of gravity. That is, sufficient mass can be provided in a portion 77 of the trigger member 76 so that the trigger member 76 is biased by the weight of the portion 77 to rotate counterclockwise from the position shown in FIG. 12 to a position similar to FIG. 11. In other embodiments, the trigger member 76 can be configured to be adjusted in other way, e.g., by a spring or by contact with another member. The rocker arm 64, latch member 42, disk 54, and handle 30 remain in the same positions as shown in FIGS. 11 and 12 while the window frame members 12, 14 are relatively adjusted and until the window 10 is closed again.

Figure 13:
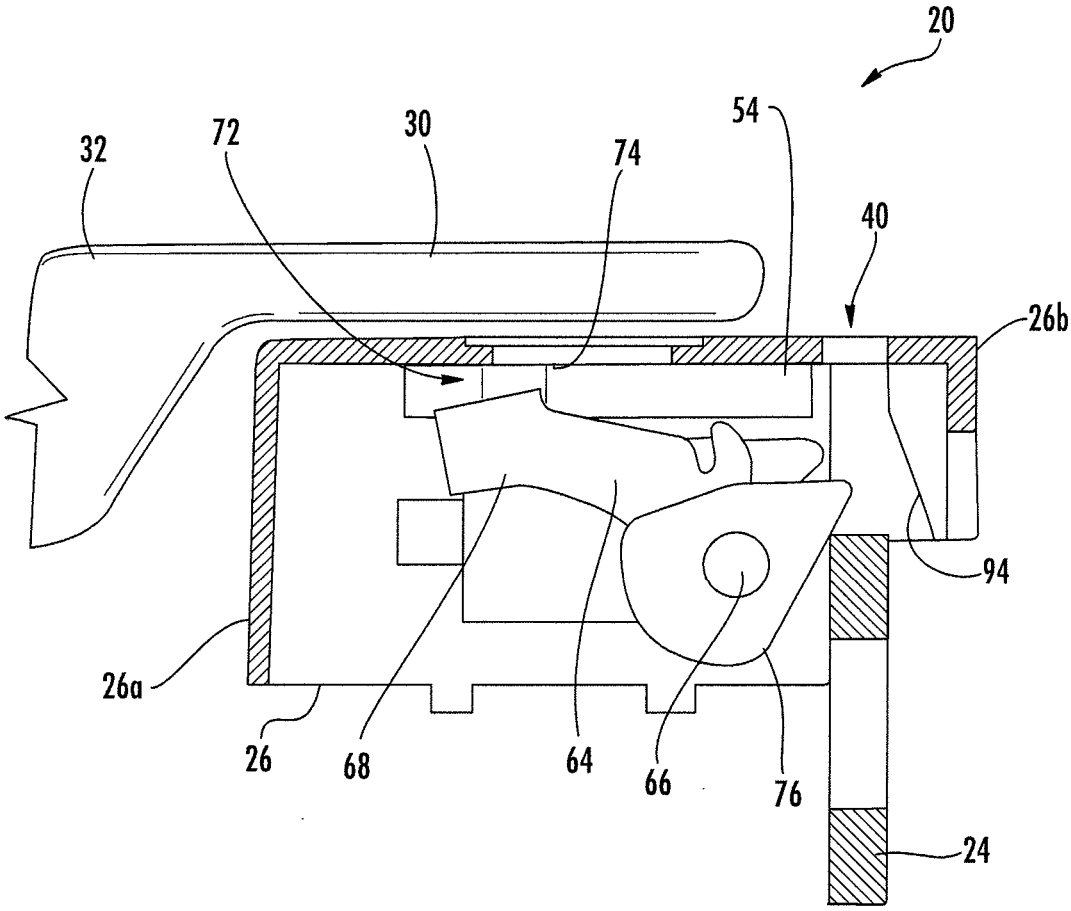
FIG. 13 is a partial cut away view in elevation schematically illustrating the window lock of FIG. 1 in an unlocked configuration, with the window partially closed.
Figure 14:
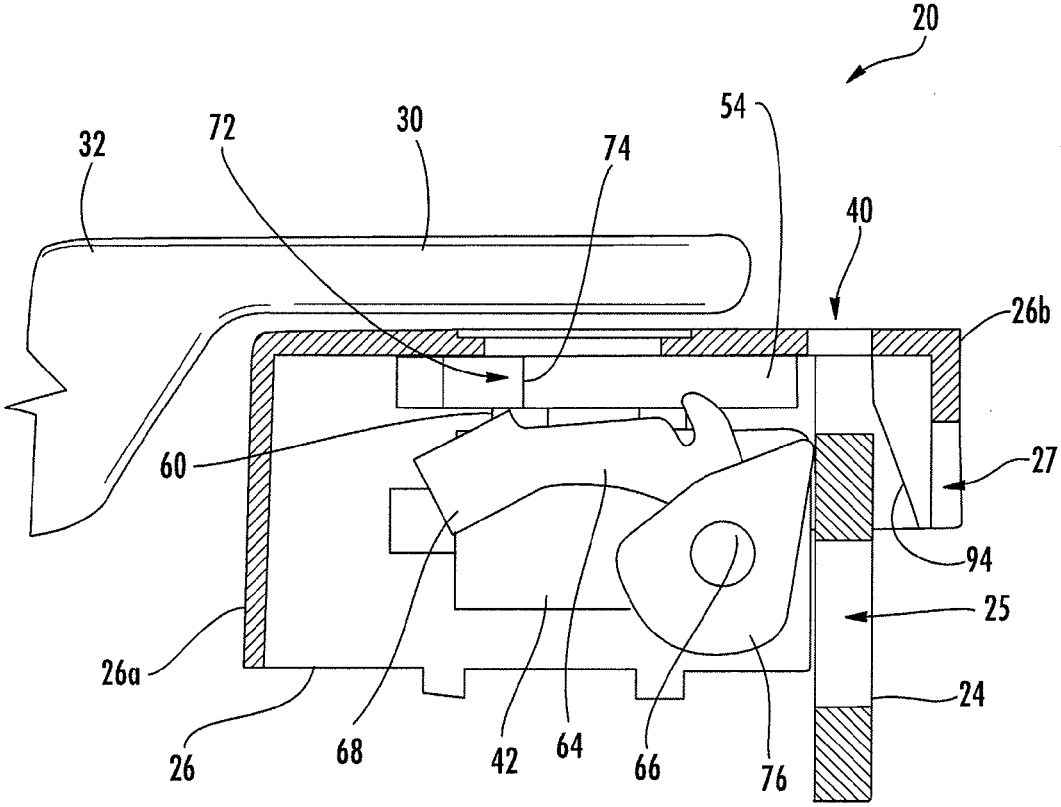
FIG. 14 is a partial cut away view in elevation schematically illustrating the window lock of FIG. 1 in an unlocked configuration, with the window closed further relative to FIG. 13.

FIG. 13 illustrates the lock 20 as the window 10 is closing, i.e., with the window 10 returned to a position that is nearly closed so that the lock 20 is again in proximity to the keeper structure 24. As the window 10 is closed, the lock 20 and keeper structure 24 move relatively in directions 92, i.e., one or both of the window frame members 12, 14 is adjusted to close the window 10. The keeper structure 24 contacts the trigger member 76 and rotates the trigger member 76 in a counterclockwise direction as shown. As the trigger member 76 rotates, the shoulder 84 of the trigger member 76 contacts the rocker arm 64 and rotates the rocker arm 64 about the axis of the shaft portion 66, overcoming the bias force of the second spring 88 member. Thus, the hook portion 68 of the rocker arm 64 is moved out of the plane of the disk 54. FIG. 13 illustrates the rocker arm 64 adjusted slightly downward relative to the disk 54 but with the rocker arm 64 still engaged to the disk 54. As the window 10 is closed further, as shown in FIG. 14, the trigger member 76 continues to rotate, thereby further rotating the rocker arm 64 and adjusting the hook portion 68 of the rocker arm 64 out of the plane of the disk 54 to disengage the hook portion 68 of the rocker arm 64 from the disk 54. With the rocker arm 64 disengaged from the disk 54, the disk 54, handle 30, and latch member 42 are no longer retained in the unlocked configuration by the retention mechanism. The first spring 86 member biases the latch member 42 toward the keeper structure 24, thereby also rotating the disk 54 and handle 30. When the retention mechanism is released, the adjustment of the latch member 42 can be impeded by the keeper structure 24. That is, the aperture of the keeper structure 24 may not be aligned with the latch member 42 until the window 10 is adjusted slightly further toward the closed position.

As illustrated in FIGS. 13 and 14, the shape of the second portion 26*b* of the housing 26 can facilitate the alignment of the keeper structure 24 with the lock 20. For example, in the illustrated embodiment, the second portion 26*b* of the housing 26 defines a surface 94 directed toward the slot 40 and angled such that the slot 40 is tapered. In particular, the width of the slot 40, measured in the direction between the first and second portions 26*a*, 26*b* of the housing 26, is greater where the keeper structure 24 is received (i.e., the bottom of the slot 40) and smaller at the opposite end of the slot 40 (i.e., the top of the slot 40 in FIGS. 13 and 14). Thus, the angled surface 94 tends to direct the keeper structure 24 toward and/or against the first portion 26*a* of the housing 26 when the window 10 is closed. In this way, the position of the keeper structure 24 proximate the latch member 42 can be ensured. Further, by securing the keeper structure 24 in a lateral direction toward the first portion 26*a* of the housing 26, any gap between the first and second window frame members 12, 14 can be closed so that the window 10 is tightly sealed.

Figure 15:
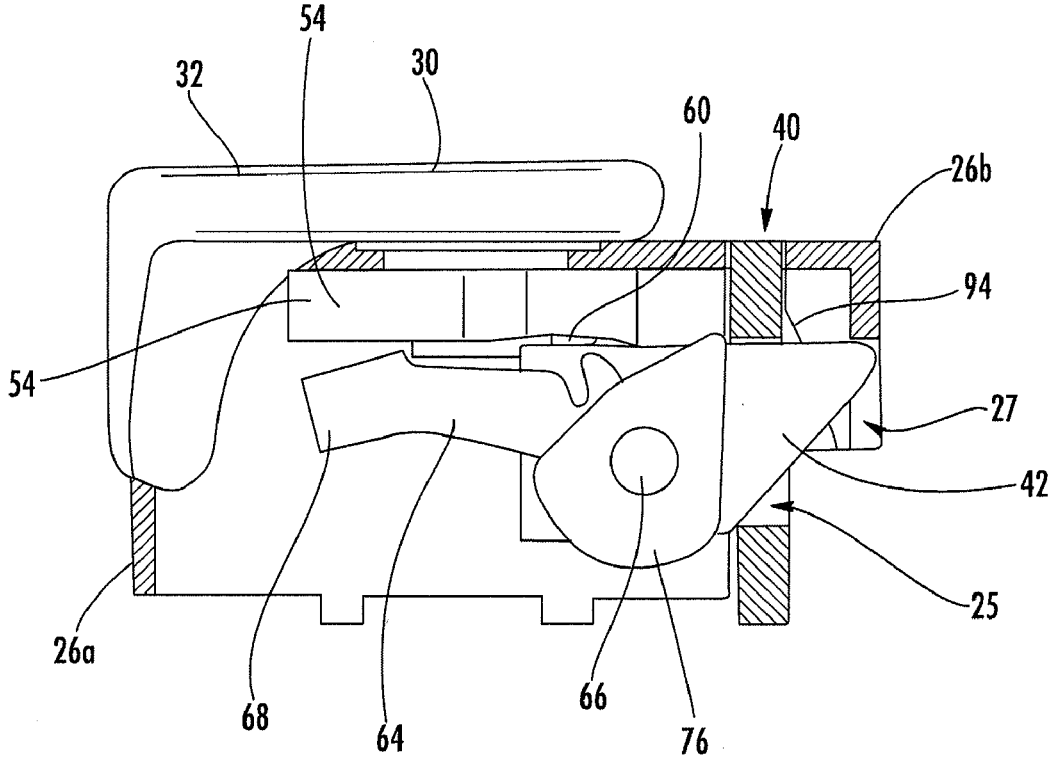
FIG. 15 is a partial cut away view in elevation schematically illustrating the window lock of FIG. 1 in a locked configuration, with the window closed further relative to FIG. 14.

FIG. 15 illustrates the lock 20 after the window 10 has been closed further, so that the latch member 42 is aligned with the aperture 25 of the keeper structure 24 and the latch member 42 is adjusted to extend at least partially through the aperture 25. For example, as illustrated in FIG. 15, the latch member 42 can extend through the keeper structure 25 and into the aperture 27 defined by the second portion 26*b* of the housing 26. As the latch member 42 is adjusted to its extended position, the post 60 extending from the latch member 42 also adjusted toward the keeper structure 24, so that the disk 54 and the handle 30 are rotated by the adjustment of the latch member 42. In this way, the handle 30 is adjusted to its locked position, and the disk 54 is rotated to a position in which the notch 72 is not aligned with the hook portion 68 of the rocker arm 64. The trigger member 76 remains in contact with the keeper structure 24, so that the shoulder 84 of the trigger member 76 is in contact with the rocker arm 64 and prevents the rocker arm 64 from moving against the disk 54.

As the window 10 is closed further, and returned to its fully closed configuration shown in FIG. 10, the trigger member 76 is aligned with the aperture 25 (or another aperture) of the keeper structure 24 so that the keeper structure 24 no longer prevents rotation of the trigger member 76. The rocker arm 64 is rotated by the bias force of the second spring 88, such that the hook portion 68 of the rocker arm 64 moves upward against the disk 54. The rocker arm 64, which is still in contact with the shoulder 84 of the trigger member 76, also rotates the trigger member 76 so that the trigger member 76 is urged at least partially into the aperture of the keeper structure 24, as shown in FIG. 10.

The adjustment of the handle 30 between the locked and unlocked configurations of the lock 20 provides a visual indication of the configuration of the lock 20, i.e., whether the latch member 42 is extended to secure the lock 20 to the keeper structure 24 and lock the window 10 or retracted so that the lock 20 is unlocked and the window 10 can be opened. Moreover, the handle 30 provides a visual indication that can be easily recognized by a user of the window 10 to easily identify if the window 10 is unlocked. That is, when the window 10 is unlocked, the handle 30 extends rearward from the housing 26 to provide a visual indication or flag that extends from the lock 20 and is easily noticed and identified by the user. When the window 10 is locked, the handle 30 does not extend rearwardly outward from the housing 26 and/or window 10 and is less noticeable. Further, it will be appreciated that the rearwardly outward extension of the handle 30 in the illustrated embodiment will be easily recognized by users who are already familiar with the locked and unlocked configurations of conventional locks that do not provide the automatic retention feature. Thus, while the locks of the various embodiments of the present invention provide a retention feature not provided by such conventional locks, the position of the handle 30 will nevertheless be easily recognizable even if the user is not familiar with the locks of the present invention or the operation of these locks. In the illustrated embodiment, the entire grip portion 32 of the handle 30 remains outside the housing 26 in both the unlocked and locked configurations so that the position of the handle 30 can easily be assessed by the user, and so that the user can easily access the handle 30 in either configuration.

Figure 16:
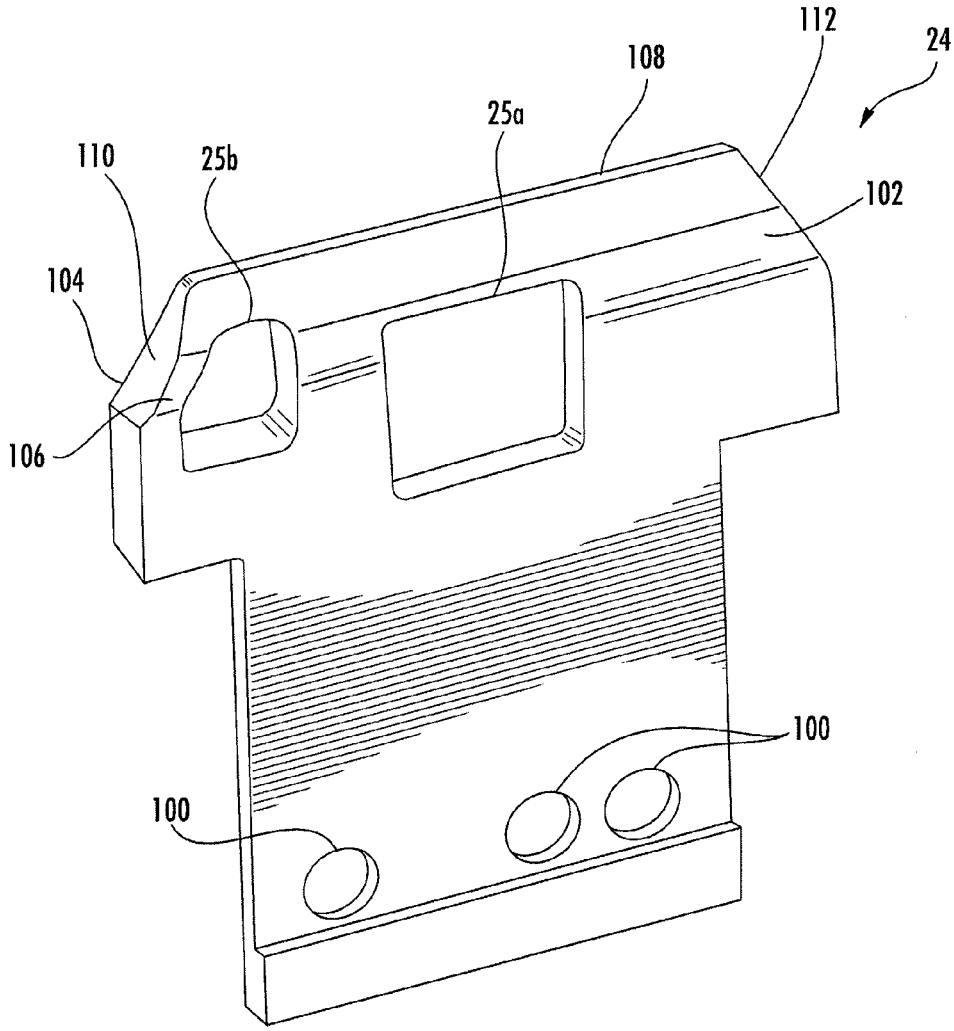
FIGS. 16-18 illustrate a keeper structure for use with the window lock according to embodiments of the present invention.
Figure 17:
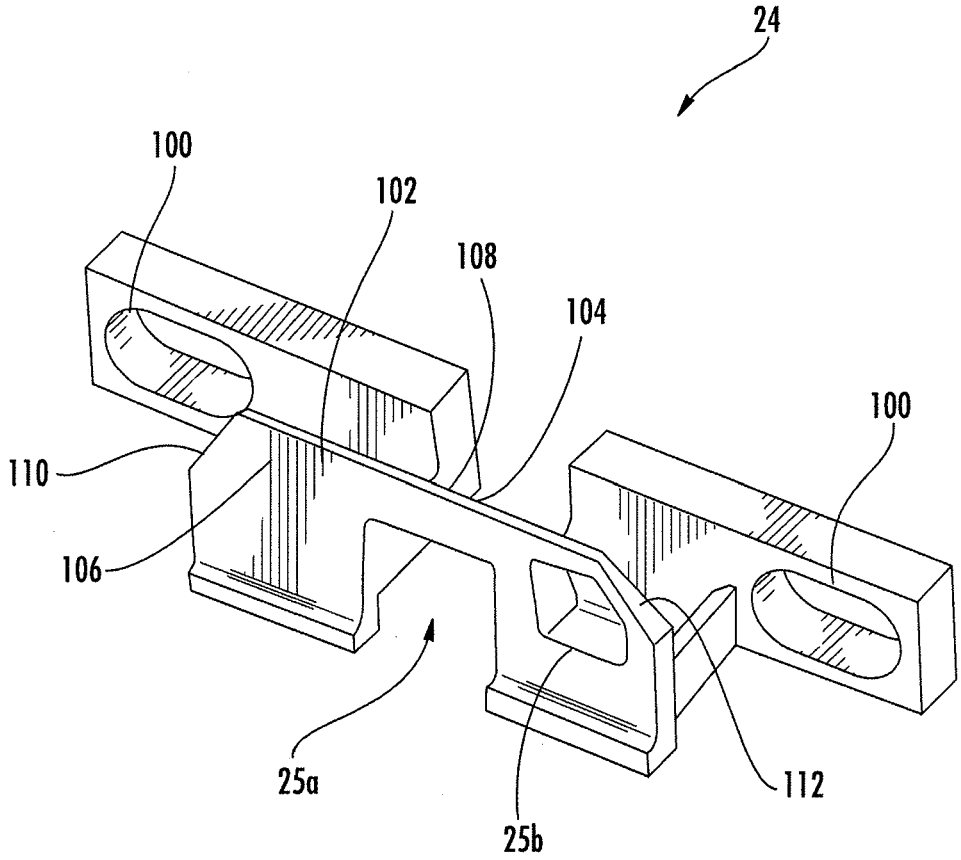
Figure 18:
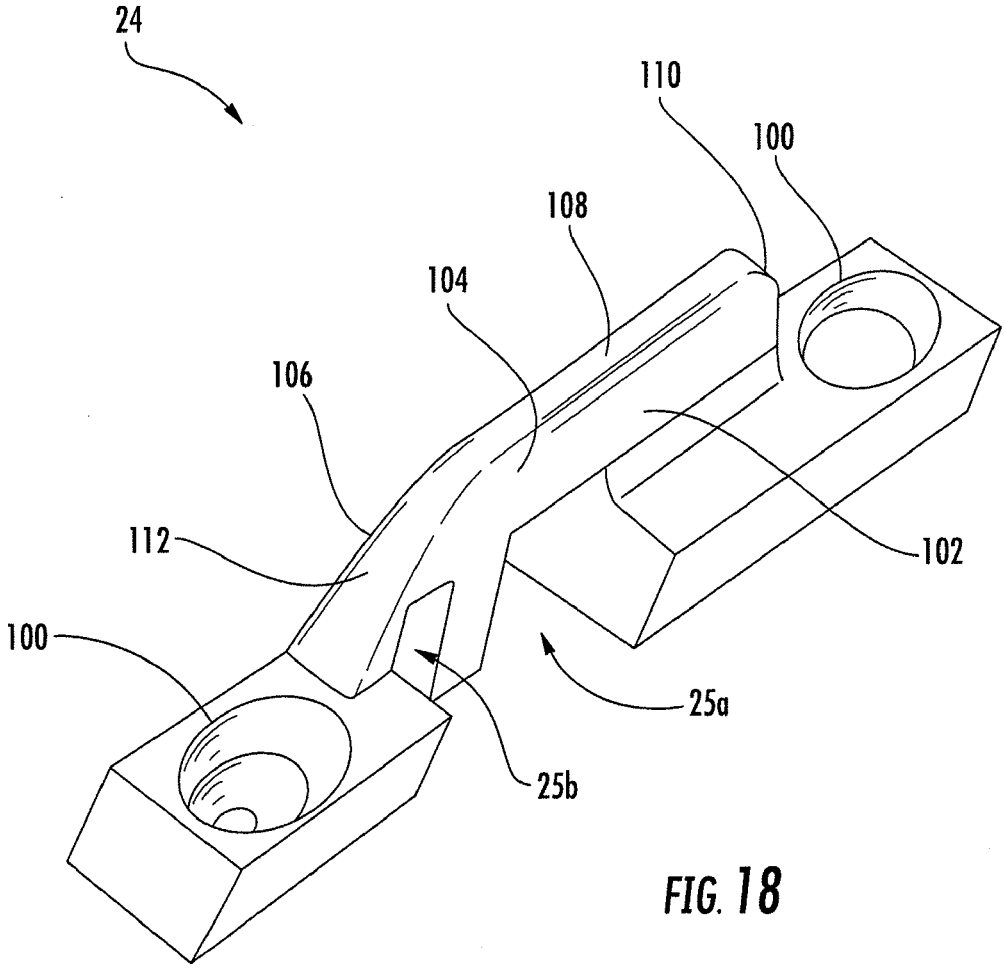

The keeper structure 24 can be configured according to the type of window 10, the lock 20, or other aspects of an installation. FIGS. 16-18 illustrate three exemplary keeper structures 24. In some cases, the keeper structure can define multiple separate apertures 25*a*, 25*b* for receiving the latch member 42 and the trigger member 76, respectively. Further, the apertures 25*a*, 25*b* can be offset in a direction parallel to the relative movement of the lock 20 and keeper structure 24 when the window 10 is opened or closed. The apertures 25*a*, 25*b* can be offset or otherwise configured so that the apertures 25*a*, 25*b* are aligned with the latch member 42 and trigger member 76 at the same time or at different times when the window is being opened or closed. That is, the aperture 25*b* can be configured to receive the trigger member 76 before or after the aperture 25*a* receives the latch member 42 when the window 10 is closed and/or when the window 10 is opened.

The keeper structure 24 of FIG. 16 defines three holes 100 for receiving fasteners, such as screws, for fastening the keeper structure 24 to the second frame member 14 of the window 10. The holes 100 extend in a direction parallel to the direction of the apertures 25*a*, 25*b*, such that the keeper structure 24 can be affixed to the window with screws or other fasteners that extend in a direction generally parallel to the direction of movement of the latch member 42. The keeper structure 24 can be abutted against a side of the second frame member 14, disposed in a slot defined by the second frame member 14, or otherwise disposed with the second frame member 14 and connected thereto. FIG. 17 illustrates a keeper structure 24 with two holes 100 for fastening to the window 10. As illustrated, the holes 100 can be slot like in configuration to allow some adjustment of the keeper structure 24 relative to the fasteners. In the FIG. 18 illustrates another keeper structure 24 having holes 100 that extend in a direction perpendicular to the apertures 25*a*, 25*b* and perpendicular to the direction of adjustment of the latch member 42. In some cases, the holes 100 are configured to be obstructed when the window 10 is closed and the lock 20 is locked. For example, the holes 100 of the keeper structure 24 of FIG. 18 can be covered by the second portion 26*b* of the housing 26 so that screws or other fasteners disposed through the holes 100 cannot be accessed or removed when the lock 20 is locked.

The keeper structure 24 can define a tapered portion 102 that facilitates the entry of the keeper structure 24 into the housing 26 of the lock 20 and/or an alignment of the keeper structure 24 with the housing 26 so that the first and second window frame members 12, 14 are properly aligned when the window 10 is closed, e.g., a "self-locating" feature. In this regard, opposite surfaces 104, 106 of the keeper structure 24 can be tapered so that a leading end 108 of the keeper structure 24, which enters the housing 26 first, is smaller in width than the other portions of the keeper structure 24. This tapering width of the keeper structure 24 can facilitate the entry of the leading end 108 of the keeper structure 24 into the slot 40 of the housing 26 even if the keeper structure 24 is slightly misaligned with the housing 26. As the keeper structure 24 is further advanced into the slot 40, the tapered portion 102 can guide the keeper structure 24 into alignment with the lock 10 if necessary. Further, the keeper structure 24 and lock 10 can be aligned so that the keeper structure 24 is directed in a lateral direction toward and/or against the first portion 26*a* of the housing 26 when the window 10 is closed. In this way, any gap between the first and second window frame members 12, 14 can be closed so that the window 10 is tightly sealed when closed. Further, the keeper structure 24 can also define convergingly angled ends 110, 112 so that the length of the keeper structure 24 tapers to facilitate the entry of the keeper structure 24 into the housing 26 even if the window frame members 12, 14 are slightly misaligned in a side-to-side direction.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A window lock for securing a first frame member of a window to a keeper structure attached to a second frame member of the window and thereby preventing a relative adjustment of the first and second window frame members in a first direction of motion, the lock comprising:

a housing configured to be secured to the first window frame member and defining an internal space;

a latch member slidably mounted in the internal space of the housing and configured to be slidably adjusted in alternate rearward and forward directions between a retracted position and an extended position, the latch member in the extended position configured to extend in the forward direction from the housing to engage the keeper structure, and the latch member in the retracted position configured to retract in the rearward direction at least partially into the housing to disengage the keeper structure;

a rotatable handle defining a shaft and a grip portion, the shaft extending through the housing and configured to actuate the latch member, and the grip portion defining an end distal to the shaft, wherein the handle is rotatably adjustable about an axis generally defined by the shaft between a locked position and an unlocked position;

a rotatable disk mounted in the internal space of the housing and connected to the shaft of the handle and the latch member, wherein the disk is configured to rotate with the shaft and the handle about the axis generally defined by the shaft of the handle, wherein the disk is also configured to adjust such that when the end of the grip portion is rotated in the rearward direction the latch member from the extended position to the retracted position when the end of the grip portion of the handle is rotated, and wherein the handle extends in the rearward direction to indicate that the latch member is retracted; and a retention mechanism configured to automatically retain the latch member in the retracted position such that the first and second window frame members can be relatively adjusted until the first and second window frame members are relatively adjusted to a closed configuration; wherein the retention mechanism comprises: a rocker arm defining an axis perpendicular to the handle shaft and a hook portion, the rocker arm being configured to rotate about the axis perpendicular to the handle between an engaged position and a disengaged position, the hook portion in the engaged position being engaged with the disk to prevent the disk from rotating and thereby holds the latch member in the retracted position, and the hook portion in the disengaged position being disengaged from the disk so that the disk is configured to rotate; and a trigger member configured to rotate between an extended position and a retracted position, the trigger member in the extended position extending from the housing and the trigger member in the retracted position being retracted at least partially into the housing such that the trigger member is configured to contact the keeper structure and be adjusted to the retracted position by the keeper structure when the window frame members are relatively adjusted to a closed configuration and the lock is thereby adjusted to a position proximate the keeper structure, the trigger member being configured to engage the rocker arm to adjust the rocker arm to the disengaged position when the trigger member is adjusted to the retracted position.

2. A window lock according to claim 1 wherein the handle in the unlocked position extends in a direction generally normal to a plane defined by each of the window frame members.

3. A window lock according to claim 1 wherein the handle in the unlocked position extends in a direction generally parallel to the sliding direction of motion of the latch member between the extended and retracted positions.

4. A window lock according to claim 1 wherein the housing defines opposite front and rear ends, the latch member being configured to extend through the front end, and the handle in the unlocked position extending rearwardly from the rear end of the housing such that the handle provides a visual indicator that the latch member is retracted.

5. A window lock according to claim 1 wherein the retention mechanism is configured to automatically release the latch member to an extended position when the window frame members are relatively adjusted to a closed configuration and the lock is adjusted to a position proximate the keeper structure.

6. A window lock according to claim 1 wherein an axis about which the handle is configured to rotate is substantially parallel to the first direction of motion of the relative adjustment of the window frame members.

7. A window lock according to claim 1 wherein the retention mechanism comprises:

at least one biasing member configured to bias the latch member to the extended position and the rocker arm to the engaged position, wherein the latch member is configured to be adjusted to the extended position when the hook portion is in the disengaged position.

8. A window lock according to claim 1, further comprising the keeper structure, the keeper structure configured to be attached to the second window frame member such that the latch member is configured to be advanced into the keeper structure when the window frame members are adjusted to the closed configuration, and the keeper structure engages the latch member when the latch member is in the extended position to prevent relative adjustment of the window frame members.

9. A window lock according to claim 1 wherein the housing defines first and second portions defining a slot therebetween for receiving the keeper structure.

10. A window lock according to claim 9 wherein the first portion of the housing defines the internal space and the second portion defines an angled surface such that the slot is tapered and the angled surface is configured to adjust the keeper structure toward the first portion of the housing as the keeper structure is received in the slot.

11. A window lock for securing a first frame member of a window to a keeper structure attached to a second frame member of the window and thereby preventing a relative adjustment of the first and second window frame members in a first direction of motion, the lock comprising:

a housing configured to be secured to the first window frame member and defining an internal space;

a latch member slidably mounted in the housing and configured to be slidably adjusted in alternate rearward and forward directions between a retracted position and an extended position, the latch member in the extended position configured to extend in the forward direction from the housing to engage the keeper structure, and the latch member in the retracted position configured to retract in the rearward direction at least partially into the housing to disengage the keeper structure;

a rotatable handle defining a shaft, the shaft extending through the housing and configured to actuate the latch member, wherein the handle is rotatably adjustable about an axis generally defined by the shaft, wherein the handle is rotatable from a locked position to an unlocked position to adjust the latch member to the retracted position, the handle in the unlocked position extending generally away from the window frame members in the rearward direction to indicate that the latch member is retracted; and a retention mechanism comprising:

a rotatable disk mounted in the internal space of the housing and connected to the shaft of the handle, such that the disk is configured to rotate with the shaft and the handle about the axis generally defined by the shaft of the handle;

a rocker arm defining a shaft portion extending perpendicular to the handle shaft and a hook portion, the rocker arm being configured to rotate about the shaft portion such that the rocker arm is adjusted between an engaged position and a disengaged position, the hook portion in the engaged position being engaged with the disk to prevent the disk from rotating and thereby holds the latch member in the retracted position, and the hook portion in the disengaged position being disengaged from the disk so that the disk is configured to rotate and the latch member is configured to be adjusted to the extended position, wherein the rocker arm is configured to automatically engage the disk to prevent the disk from rotating and prevent the latch member from moving to the extended position when the window frame members are relatively adjusted in an open configuration;

a trigger member configured to rotate between an extended position and a retracted position, the trigger member in the extended position extending from the housing and the trigger member in the retracted position being retracted at least partially into the housing such that the trigger member is configured to contact the keeper structure and be adjusted to the retracted position by the keeper structure when the window frame members are relatively adjusted to a closed configuration and the lock is thereby adjusted to a position proximate the keeper structure, the trigger member being configured to engage the rocker arm to adjust the rocker arm to the disengaged position when the trigger member is adjusted to the retracted position, such that the rocker arm disengages the disk and the latch member is automatically adjusted to the extended position and the handle is adjusted to the locked position when the window frame members are adjusted to the closed configuration and the lock is adjusted to a position proximate the keeper structure; and at least one biasing member configured to bias the latch member to the extended position and the rocker arm to the engaged position.

12. A method for securing a lock attached to a first frame member of a window to a keeper structure attached to a second frame member of the window and thereby preventing a relative adjustment of the first and second window frame members in a first direction of motion, the method comprising:

providing a housing secured to the first frame member of the window;

providing a handle extending from the housing, wherein the handle is defined by a shaft and a grip portion, the shaft extending through the housing and configured to actuate a latch member, and the grip portion defining an end distal to the shaft;

rotating the handle about an axis generally defined by the shaft between a locked position and an unlocked position, wherein rotating the handle thereby rotates a disk mounted in the housing and connected to the shaft of the handle and configured to rotate with the shaft and the handle about the axis generally defined by the shaft of the handle, wherein rotating the disk thereby slidingly retracts the latch member from an extended position in the keeper structure to a retracted position at least partially into the housing;

relatively adjusting the window frame members from a closed configuration to an open configuration such that the lock is moved from the proximity of the keeper structure, while the latch member is automatically retained in the retracted position by a retention mechanism;

thereafter, relatively adjusting the window frame members from the open configuration to the closed configuration such that the lock is moved proximate the keeper structure, the retention mechanism releases the latch member, and the latch member is automatically adjusted to the extended position to lock the window, wherein the step of automatically retaining the latch member includes rotating the rocker arm about an axis perpendicular to the handle shaft so that a hook portion engages the disk to prevent the disk from rotating and thereby holds the latch member in the retracted position, and wherein the step of adjusting the window frame members to the closed configuration comprises contacting a trigger member with the keeper structure such that the trigger member rotates at least partially into the housing to engage the rocker arm and adjust the rocker arm to disengage the rocker arm from the disk.

13. A method according to claim 12 wherein the step of relatively adjusting the window frame members to the closed configuration comprises automatically adjusting the handle to the locked position by a bias member, the handle in the locked position extending generally parallel to the window frame members.

14. A method according to claim 12 wherein the step of rotating the handle to the unlocked position comprises manually rotating the handle to a configuration in which the handle extends in a direction generally parallel to a sliding direction of motion of the latch member.

15. A method according to claim 12 wherein the step of rotating the handle to the unlocked position comprises manually rotating the handle to retract the latch member through a front end of the housing and adjusting the handle to extend from a rear end of the housing opposite the front end such that the handle provides a visual indicator that the latch member is retracted.

16. A method according to claim 12 wherein the step of rotating the handle comprises rotating the handle about an axis substantially parallel to a direction of motion of the relative adjustment of the window frame members.

17. A method according to claim 12 wherein the step of adjusting the window frame members to the closed configuration comprises adjusting the rocker arm to disengage the rocker arm from the disk such that the disk and the handle rotate to an unlocked configuration as the latch member is adjusted to the extended position by a biasing member.

18. A method according to claim 12 wherein the step of adjusting the window frame members to the closed configuration comprises receiving the keeper structure at least partially into a slot defined between first and second portions of the housing and extending the latch member through the keeper structure and at least partially into the second portion of the housing to prevent relative adjustment of the window frame members.

19. A method according to claim 18 wherein the step of receiving the keeper structure at least partially into the slot comprises relatively adjusting the housing and the keeper structure such that the keeper structure contacts an angled surface defined by the second portion of the housing and is thereby adjusted toward the first portion of the housing as the window is closed.

* * * * *